United States Patent [19]

Michelson

[11] 4,140,171

[45] Feb. 20, 1979

[54] NO BAKE BLOWER APPARATUS FOR MAKING SAND CORES

[75] Inventor: Anatol Michelson, Columbus, Ohio

[73] Assignee: Ashland Oil, Inc., Ashland, Ky.

[21] Appl. No.: 822,555

[22] Filed: Aug. 8, 1977

[51] Int. Cl.[2] ..... B22C 15/24

[52] U.S. Cl. ..... 164/158; 164/169; 164/201

[58] Field of Search ..... 164/20, 158, 159, 169, 164/200, 201

[56] References Cited

U.S. PATENT DOCUMENTS

| | | | |
|---|---|---|---|
| 2,680,889 | 6/1954 | Herbruggen | 164/201 |
| 2,779,074 | 1/1957 | Herbruggen | 164/20 |
| 2,793,409 | 5/1957 | Hansberg | 164/201 |
| 2,814,083 | 11/1957 | Beyer | 164/158 |
| 2,957,222 | 10/1960 | Zmania et al. | 425/219 |
| 3,181,207 | 5/1965 | Schoeble et al. | 164/201 X |
| 3,212,141 | 10/1965 | Hansberg | 164/201 X |
| 3,556,195 | 1/1971 | Lund | 164/201 |
| 3,799,714 | 3/1974 | Vetovitz | 425/456 X |
| 4,050,504 | 9/1977 | Hansberg | 164/201 |

*Primary Examiner*—Robert L. Spicer, Jr.
*Attorney, Agent, or Firm*—Wood, Herron & Evans

[57] ABSTRACT

A no bake blower for making sand cores.

A blow head has a blow plate detachably mounted at the lower end of the blow head and adapted to be moved vertically away from the blow head. The blow head is movable horizontally with respect to the blow plate and in so doing scrapes residual sand off the blow plate.

A blow plate cleaning mechanism is carried by the blow head into vertical alignment with the blow plate after the blow head has been horizontally moved. The cleaning mechanism has vertical rods which pass through the blow holes in the blow plate to remove residual sand from them.

18 Claims, 23 Drawing Figures

NO BAKE BLOWER APPARATUS FOR MAKING SAND CORES

This invention relates to a method and apparatus for making sand cores.

In modern foundry practices, there are three principal processes for making sand cores, namely, a hot process, a cold box process and a no bake process. Each of these processes is distinguished by the manner in which the binder is formed and set. More particularly, in making of a core the sand is mixed with a binder, disposed in a core box, and while in the core box, the binder is set so as to make the sand particles adhere to one another thereby forming a core which has the desired structural integrity to enable it to be handled.

In the hot process, a binder which is set by the application of heat to the binder is mixed with the sand and after the core is formed in the core box, the sand and binder mixture are subjected to heat. Not only does the process of setting the binder require a substantial amount of time, but additionally, the core is hot to handle after it has been made, thereby causing delays in the further processing of the cores.

The second process is the cold box process in which two binder-forming constituents are mixed with sand which is then blown by automatic equipment into a core box. The sand in the core box is then subjected to a gas catalyst which very quickly sets the binder (in about 2 seconds). Thereafter, the core box and core are subjected to cleansing air.

The gas catalyst is quite noxious, and as a consequence very sophisticated apparatus must be provided to be sure that there is no escape of the gas during the process, and further to provide that the catalyst gas after use is cleaned or incinerated.

The cold box process is very rapid, but has the disadvantages of requiring the automatic equipment and requires coping with the problems attending the noxious gas.

The third process is the no bake process and involves the use of two binder constituents and a catalyst. When the three are mixed together, the binder sets without the addition of heat. The speed with which the binder sets can be regulated by the amount of catalyst applied to the mixture.

In the no bake process, the sand and binder are mixed in batches of slightly greater quantity than the amount of sand required for the core. The batch and sand and binder is then quickly poured from the mixer into the core box and excess sand is scraped away by hand. The binder can set very rapidly, that is, within a matter of 15 - 30 seconds or so, thereby forming a core.

The no bake process has not admitted of the use of automated equipment for conveying or blowing the sand into a core box for once the binder is mixed with the sand, it will inevitably and quickly set and any portions of the sand and binder adhering to parts of automatic machinery will set on the machinery within the short time that the binder in the core box sets. For this reason, the no bake process has been largely a hand-operated processin which the sand is poured directly from a mixer into a core box where it is tamped by hand and the excess sand is also used so as to be sure that the core box is full to overflowing thereby avoiding any possibility of making an incomplete core.

The objective of the present invention has been to provide a process and automatic apparatus for making sand cores by the no bake process. The invention provides a process for making sand cores which is comparable in speed and efficiency to the cold box process but avoids the disadvantage of the noxious gas catalyst required by the cold bake process. Still further, as compared to present no bake processes, the process and apparatus of the invention substantially reduces the sand residue which causes a wastage of the binder.

This objective of the invention is attained by providing sand blower apparatus capable of transmitting sand from a mixer to a core box with provision for cleaning those portions of the apparatus to which sand is likely to adhere.

The apparatus includes a hopper and a blow head upon which high frequency vibrators are mounted. The hopper and blow head have primarily vertical walls through which the sand passes, and these vertical walls, coupled with the vibrators, prevent the adherence of the sand to the walls of the elements.

The lower end of the blow head has a blow plate which contains a plurality of blow tubes which extend into a core box. A blow plate having blow tubes is conventional, however, in accordance with the present invention, the blow plate is movably mounted with respect to the blow head so that it is removable at the end of each cycle for cleaning purposes as will appear.

Another feature of the invention resides in the providing of mechanism for moving the entire blow head assembly, except for the blow plate, horizontally to move the blow head assembly out of the way of the blow plate. Thus, the blow plate has an independent mechanism for imparting vertical motion to it while the blow head has independent mechanism for applying horizontal motion to it. These motions permit the blow plate to be lowered away from the blow head and the blow head to be subsequently moved horizontally with respect to the blow plate for the purpose of cleaning the blow plate.

A further feature of the invention consists in mounting of a spring-loaded scraper on the blow head. During horizontal movement of the blow head the spring-loaded scraper wipes across the upper surface of the blow head after sand has been introduced into the core box and scrapes away the residual sand.

Another feature of the invention resides in the mounting of a cleaning head on the blow head assembly. The cleaning head is normally located to one side of the blow plate and core box. However, when the blow head is moved sideways with respect to the blow plate, it carries the cleaning head into vertical alignment with the blow plate. When vertically aligned, the lower portion of the cleaning head is driven downwardly and cleaning rods project into the blow tubes of the blow plate thereby forcing the residual sand out of them.

Optionally, the cleaning head can be used in conjunction with the core-forming process so that in forcing the residual sand from the blow tubes, the residual sand is forced into the core box itself and thereby effecting a compacting of the sand in the core box and eliminating any sand projections from the core after it is formed From the foregoing, it can be seen that the steps of shifting the blow head in a horizontal direction performs the functions of moving the blow head out of the way of the blow plate, it effects the scraping of residual sand from the blow plate, and it moves the cleaning head into a position of vertical alignment with the blow plate.

Still another feature of the invention resides in the provision of a lower tier of compressed air which is injected into the blow head immediately adjacent the blow plate. The lower tier of air works in conjunction with the air which is introduced into a vertical sleeve forming the central chamber of the blow head through very thin slots formed in the sleeve. Still a further tier of air at the upper end of the sleeve is introduced through a manifold and is injected downwardly toward the blow plate.

The lower tier of air constitutes a laminar agitator and includes a plurality of nozzles, for example, four, which blow across separate quadrants of the blow plate. Air is injected into the chamber through these nozzles in very short spurts, each lasting a very small fraction of a second. The blast may occur simultaneously or sequentially around the periphery of the agitator.

The lower laminar agitator, works in concert with the upper ties of air, which blow the sand into the core box and keeps the sand moving continuously and in a generally horizontal direction over the blow holes in the blow plate so as to avoid the formation of craters. Craters occur when a path is formed through the sand to the blow tube. All of the air then tends to pass through that cleared path directly into the core box thereby conveying no sand or very little sand into the core box thus greatly reducing the efficiency of the transmission of the sand from the blow head into the core box.

Another feature of the invention resides in the placing of a seal between the blow plate and blow head on the blow head so that when the blow plate is separated from the blow head, the scraper can move across the blow plate without adversely affecting the seal.

Another feature of the invention resides in the mounting of the blow plate by means of vertical disconnect rods which depend from the machine frame at the upper portion of the frame. The disconnect rods are adapted to be disconnected intermediate their ends and the lower portions swung downwardly and connected to the machine frame which raises and lowers the core box.

This feature of the invention is utilized when a fault occurs whereby the sand and binder do not flow into the core box but rather are retained in the blow head resting on the blow plate. When this conditions arises, the lower portions of the disconnect rods are swung down and connected to the machine table. The machine table can then pull the blow plate downwardly, separating it from the blow head and pulling the set-up sand from the blow head.

Still another feature of the invention resides in the provision of a waste hopper alongside the machine table. The waste hopper has a pivotally-mounted shield which in one position is in condition to guide the sand scraped from the top of the blow plate into the waste receptacle.

In another position, after the core box has been lowered away from the blow head, the shield lies between the core box and the blow head so that when the cleaning head moves into engagement with the blow plate, the sand discharged from the blow plate flows onto the shield and then slides into the waste receptacle.

Still another feature of the invention resides in the providing of the blow plate with a plurality of blow tubes, the tubes having their centers spaced from each other approximately two times the diameter of each blow tube. The use of a large number of blow tubes thusly spaced greatly reduces the residual sand left on the blow plate and thereby reduces the wasted binder.

Still another feature of the invention resides in the providing of an interconnection between the blow head and cope or upper portion of the core box to prevent downward movement of the cope when the blow head is in vertical alignment with the core box. When in this attitude, the lowering of the machine table carrying the core box causes the drag, or lower portion of the core box, to move downwardly. The retention of the upper portion of the core box, however, causes the cope to strip away from the core thereby exposing the core which is thereafter lifted out of the drag and placed on a conveyor for further processing.

The several objectives and features of the invention will become more readily apparent from the following detailed description taken in conjunction with the accompanying drawings in which:

FIG. 7 is an enlarged sectional view of the cleaning tubes in relation to a blow tube;

Figure 1:
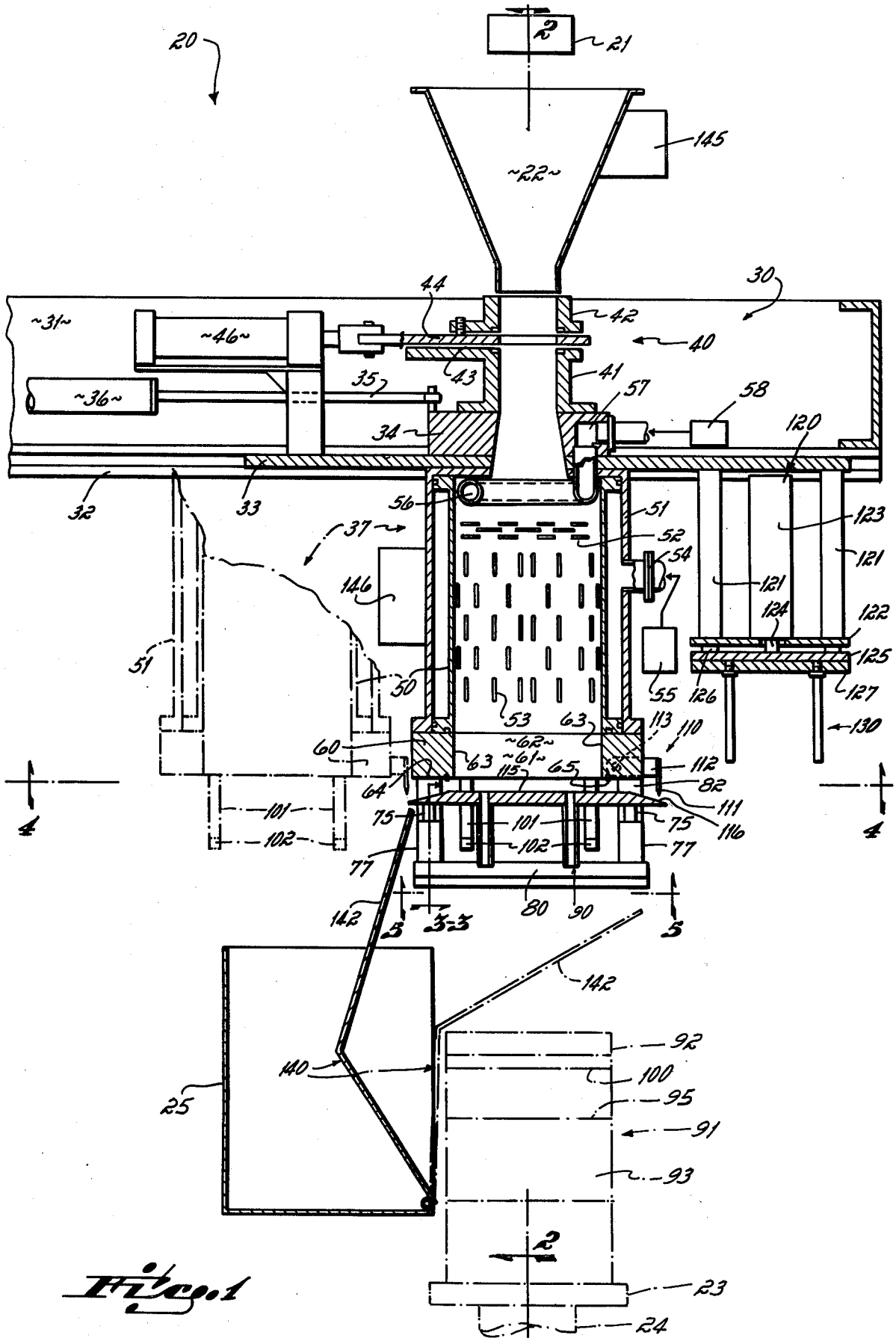
FIG. 1 is a side elevational view of the machine, partly in section.
Figure 2:
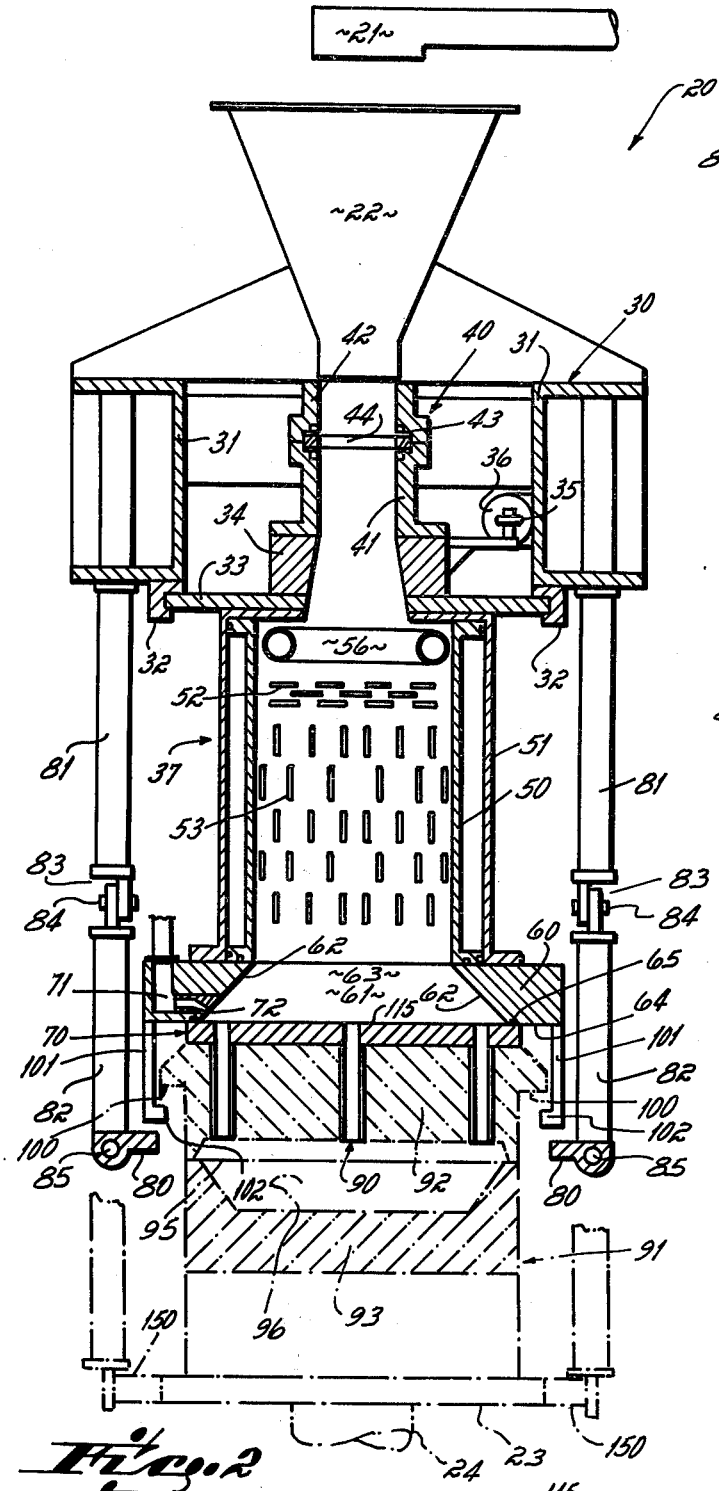
FIG. 2 is a cross-sectional view taken along lines 2—2 of FIG. 1.
Figure 5:
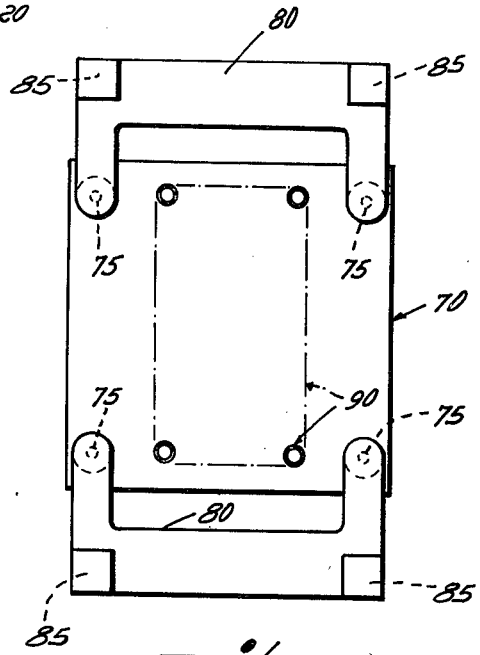
FIG. 5 is a bottom plan view taken along lines 5—5 of FIG. 1.
Figure 6:
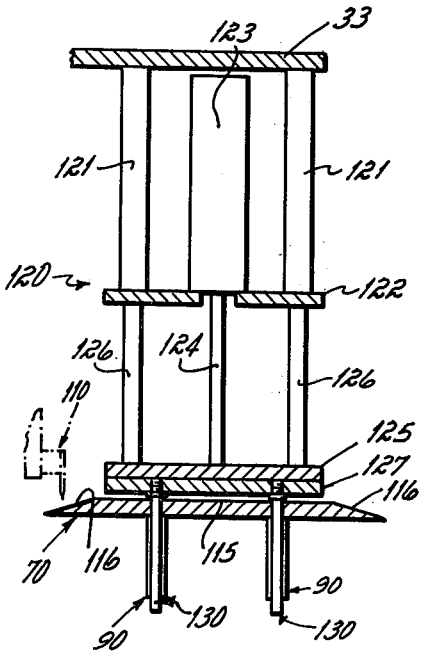
FIG. 6 is a side elevational view partly in section of the cleaning head in operative position with respect to the blow plate.

Referring to FIGS. 1 and 2, a no bake blower is indicated at 20 and is used in association with a mixer 21 located over the blower, the mixer 21 being associated with a funnel-shaped hopper 22 which feeds into the blower. Located below the blower is a machine table 23 having hydraulic or pneumatic mechanism 24 for raising and lowering it. Alongside the machine table is a waste receptacle 25.

The blower is mounted on a machine frame 30 consisting of two parallel channel-shaped members 31. A pair of opposed guides 32 or ways are supported on the lower surfaces of the channel members 31. A plate 33 is slidably mounted in the ways. The plate has fixed to it a block 34 which is connected to a rod 35 of a piston which is in a double-acting cylinder 36 fixed to the frame 30. The double-acting piston rod and cylinder 35, 36 causes the block 34 and plate 33 to move horizontally with respect to the frame 30 and carry with it a blower head 37 to be described below.

The blower head 37 which is mounted on the plate 33 includes a gate valve 40 having a lower member 41 fixed on the block 34 and an upper member 42 secured to the lower member. The valve has a longitudinal passageway 43 through which a gate 44 slides to open and close the valve. The gate is connected to a double-acting pneumatic piston and cylinder 46 fixed to the plate 33 so as to move with the plate when the blower head is shifted horizontally.

A sleeve 50 is mounted below the valve 40. The sleeve 50 is surrounded by an inverted cup-shaped member 51 which is circumferentially spaced from the sleeve to form a manifold chamber for introduction of air through the sleeve. The sleeve contains at its upper portion a plurality of circumferential slots 52 and the lower portion a plurality of spaced vertical slots 53. The slots are long but are also quite thin, being less than the diameter of the sand particles which will pass through the blow head.

A fitting 54 is connected to the cup-shaped elements 51 and is connected to a supply of compressed air as indicated at 55.

A circular manifold 56 is located at the upper end of the sleeve and is connected by means of an L-shaped fitting 57 to a supply of compressed air 58 which is directed downwardly through openings 59. The circular manifold 56 forms the upper tier of air and the sleeve provides an intermediate tier of air.

The upper manifold 56 and the slotted sleeve 50 are conventional systems for introducing a sand mix into a blow head and forcing the sand mix through the blow head and into the core box.

Figure 8:
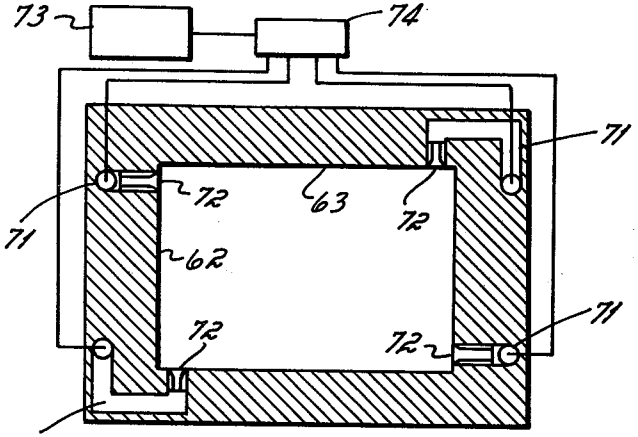
FIG. 8 is a cross-sectional view taken along lines 8—8 of FIG. 2, and showing the laminar agitator.

At the lower end of the blow head is a ring 60 forming a blow chamber 61. The blow chamber has tapered or outwardly flaring end walls 62 and vertical side walls 63. The ring 60 has a downwardly-facing surface 64 in which a sealing cord 65 is fixed. A blow plate 70 is mounted below the ring 60 and is vertically movable so as to be tightly clamped against the ring 60 and sealed by the cord 65 during the time that the sand mix is introduced into the blow head and passed through the blow plate into the core box. The ring has a plurality of nozzles 71 spaced around its periphery. As shown in FIG. 8, four such nozzles 71 are shown. The discharge end of the nozzles 72 are downwardly inclined so as to direct the blast across the blow plate when the blow plate is in operative position of engagement with the ring 60.

A compressed air supply 73 is connected through a valve mechanism 74 to the four nozzles. Preferably, the valve mechanism is operable to connect the respective nozzles sequentially to the air supply with each nozzle being connected to the air supply for a small fraction of a second, as, for example, 1/50 of a second. It is recognized that the nozzles could be connected simultaneously to the air supply. The total time of operation of the nozzles 71 will be no more than about 1 ½ seconds.

The nozzles 71 constitute a laminar agitator which, in conjunction with the incoming air through the sleeve 50 and the circular manifold 56, will effect the movement of the sand mix through the blow head into the core box below the blow plate 70. The laminar agitator, being directed across the blow plate, will provide assurance of a uniform and continuous distribution of sand mix across the surface of the blow plate, thereby avoiding the formation of undesirable craters in the said mix which adversely affect the rapid flow of sand through the blow plate into the core box. In other words, a crater passing through relatively static sand will provide a passage of least resistance for the air coming into the blow head through the upper tiers so that that air will pass through the crater into the core box without driving sand mix into the core box.

Figure 3:
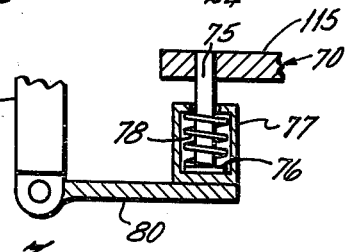
FIG. 3 is a fragmentary cross-sectional view taken along lines 3—3 of FIG. 1.
Figure 1:
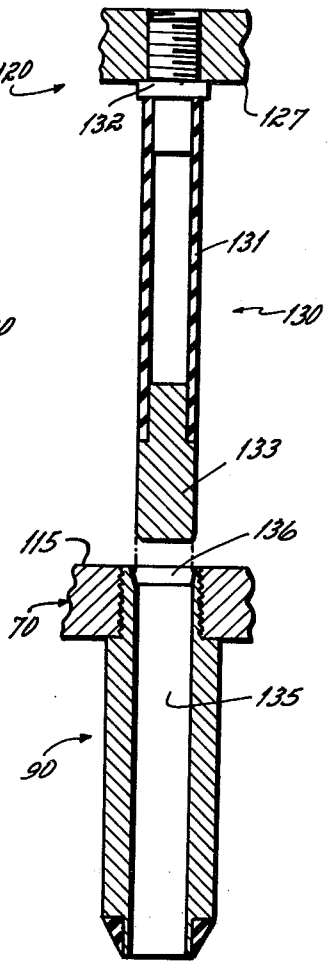

The blow plate is mounted at each side on pins 75 which have cups 76 at their lower ends. The cup 76 is slidable in a cylinder 77. A compression spring 78 (FIG. 3) is mounted in the cylinder between the cup and cylinder to urge the blow plate 70 downwardly.

The cylinders on each side are mounted on bars 80 extending across the blow head. The bars 80 are supported on upper and lower disconnect rods 81, 82, respectively, which are connected together at 83 by removable pins 84. The lower end of each lower rod is pivotally connected at 85 to a bar 80. The upper rod 81 is fixed to the frame 30 and is thus suspended from the frame.

Figure 9:
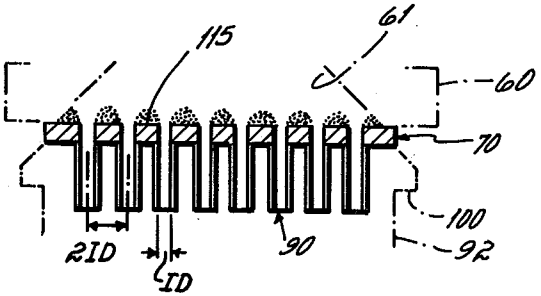
FIG. 9 is a cross-sectional view through the blow plate.

As best seen in FIG. 9, the blow plate 70 has a plurality of blow tubes 90 depending from it. The blow tubes are uniformly distributed around the area of the blow plate and are spaced from each other by approximately twice the inside diameter of each blow tube. In other words, if the blow tube's inside diameter is ID, the blow tubes will be on centers 2ID. This close spacing of the blow tubes, coupled with the laminar agitator, reduces to a minimum the amount of residual sand mix which will remain on the top of the blow plate after the sand mix has been discharged into the core box.

The core box is indicated at 91 and has an upper portion 92 which is the cope and a lower portion 93 which is the drag. The parting line formed between the cope and the drag is indicated at 95. The cope and the drag form a chamber 96 (FIG. 2) which is in the configuration of the core to be formed by the sand mix. The cope has a plurality of passageways which have a pattern identical to that of the blow tubes depending from the blow plate so that when the blow plate is positioned on top of the drag, as shown in FIG. 2, the blow tubes pass through the drag so as to be in a position to discharge sand mix directly into the core-forming chamber 96.

The cope has longitudinal flanges 100 projecting outwardly. The ring 60 has depending brackets, 101 terminating at their lower ends in inwardly directed legs 102 which underlie the flange 100 of the cope. When the core box is lowered, as will be described below, the flanges 100 will engage the legs 102 on the brackets 101 and restrict the downward movement of the cope so that as the drag continues to move downwardly it will pull away from the cope exposing the formed core for removal.

The core box is mounted on the machine table 23 which is in turn supported on a piston and cylinder 24 for raising and lowering the core box with respect to the blow head.

Figure 4:
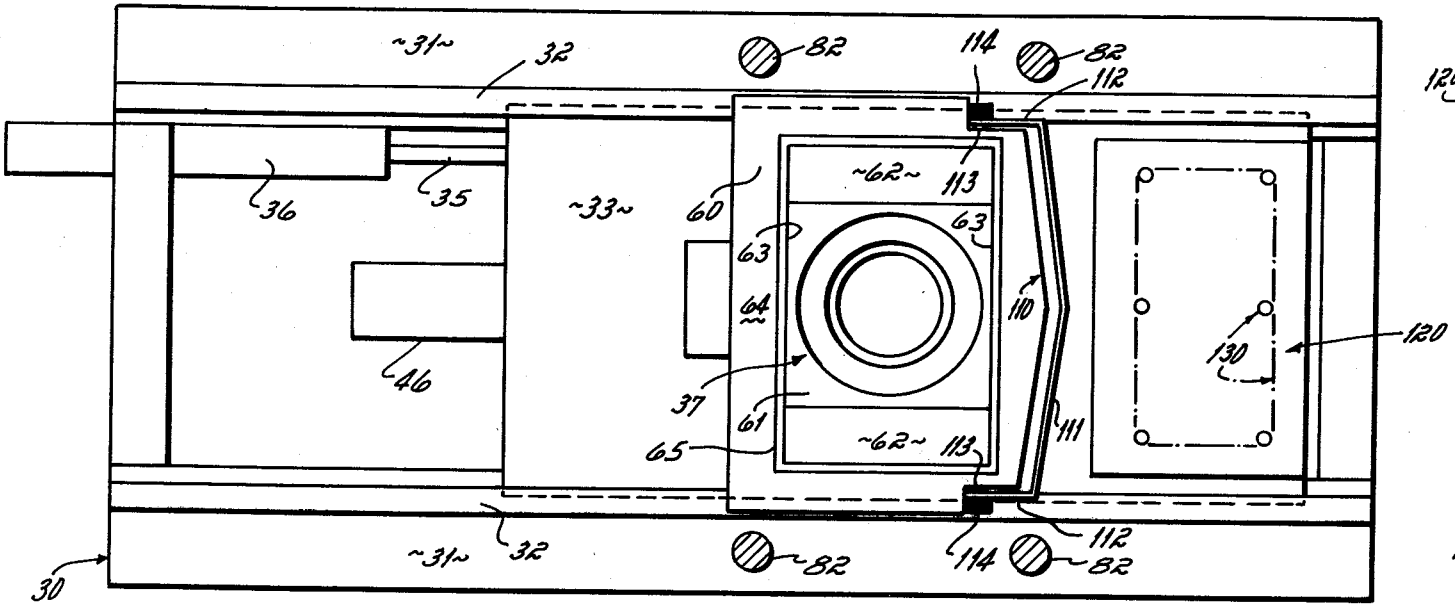
FIG. 4 is a bottom plan view taken along lines 4—4 of FIG. 1.

The apparatus has cleaning mechanisms best shown in FIG. 1. The ring 60 supports a scraper 110 which has a downwardly directed blade 111. The scraper is mounted on an arm 112 which is pivoted at 113 to the ring 60. A spiral spring 114 (FIG. 4) urges the scraper downwardly to the position shown in FIG. 1 where it is blocked from further downwardly-swinging movement by an abutment (not shown). In this position, the blade 111 is slightly below the upper surface 115 of the blow plate, that upper surface having tapered side edges 116. When the blow head is moved horizontally with respect to the blow plate, with the blow plate being spaced slightly downwardly from the blow head, the scraper will scrape any residual sand mix remaining on top of the blow plate across the blow plate for discharge into the waste receptacle 25.

A blow tube cleaning mechanism 120 is supported on plate 33 alongside the blow head 37. It includes vertical guide tubes 121 which depend from the plate 33 and support a plate 122. A double-acting cylinder 123 is mounted on the plate 122 and has a piston rod 124 extending downwardly therefrom, the piston rod being connected to a plate 125. The plate 125 has upwardly projecting rods 126 which are slidable in the guide tubes to guide the plate 125 as it is raised and lowered. The plate 125 has another plate 127 removably mounted on its lower surface, the plate 127 carrying cleaning rods 130. The cleaning rods are mounted on the plate 127 in a pattern identical to that of the blow tubes 90 on the blow plate 70.

As shown in FIG. 7, each cleaning rod is formed by an elastomeric tube 131 which is secured at its upper end to a fitting 132 threaded into the plate 127. A hardened steel tip 133 is fixed in the lower end of the elastomeric tube.

Each blow tube 90 has a bore 135 which has an outwardly flaring upper end 136 by which the cleaning rod is guided into the blow tube. The hardened steel tip 133 has an outside diameter which is just slightly less than that of the blow tube so that as it passes through the blow tube it will sweep the blow tube clear of any sand particles.

The mechanism is arranged so that when the blow head is moved horizontally toward the left as viewed in FIG. 1 to the phantom line position, the cleaning mechanism 120 will precisely overlie the respective blow tubes in the blow plate 70. In this position, introducing air into the actuator cylinder 123 will cause the cleaning rods to lower and enter the blow tubes to clean the blow tubes. As stated above, the waste receptacle 25 is located below the blow head and to one side of the machine table which carries the core box.

The waste receptacle has a pivoted side wall 140. When the blow head is in its operative position, the side wall 140 is in a generally vertical orientation with its upper section 142 adjacent the edge of the blow plate 70. In this orientation, when the blow head is moved horizontally to the inoperative phantom line position, the scraper 110 moves the residual sand mix across the left-hand edge of the blow plate where it is guided by the upper section 142 into the waste receptacle 25.

When the core box is lowered as shown in phantom lines in FIG. 1, the side wall 140 swings to an inclined attitude, also shown in phantom, with the upper section 142 underlying the blow plate. When the cleaning rods 130 pass through the blow tubes, the sand discharged from the blow tubes is received by the side wall 140 and guided into the waste receptacle.

A high frequency vibrator 145 is mounted on the funnel-shaped hopper 22 and a high frequency vibrator 146 is mounted on the side of the blow head. The vibrators function to reduce the likelihood of any sand mix particles clinging to the vertical walls of the machine elements as a charge passes from the mixer through the blow head into the core box.

Referring to FIG. 2 the machine table which supports the core box has lateral fittings 150 which are adapted to receive the upper ends of the rods 82, the upper ends being adapted to be connected by the pins 84 to the fittings 150 on the machine table. The pivotal mounting 85 of the rods 82 permit them to be swung from their upper position wherein they are connected to the upper rods 81 to a downward position shown in phantom lines in FIG. 2 where they are connected to the machine table. This arrangement permits the removal of a charge of sand from the blow head in the event of a failure of the mechanism which prevented flow of the sand mix from the blow head into the core box. In the event of such an occurrence the rods 82 are swung downwardly and connected to the machine table. Thereafter, the machine table is lowered thereby drawing the core box and blow plate downwardly. As the blow plate moves downwardly, it withdraws the charge from the blow plate and permits cleaning of that charge of sand mix out of the apparatus. For this purpose, the brackets 101 are mounted in such a way that they can be swung out of the path of the cope.

Operation

Figure 10:
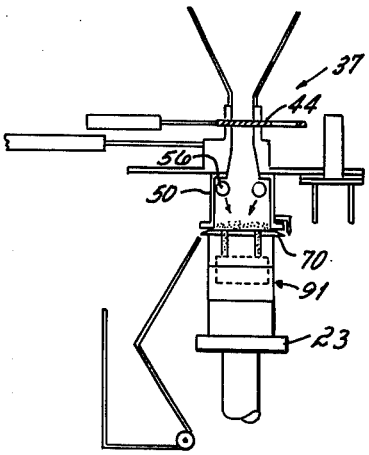
FIGS. 10–23 are diagrammatic illustrations of the sequence of operations of the apparatus.

In considering the operation of the apparatus, let it be assumed that the cycle begins after a charge of sand mix has been introduced into the blow head 37. As shown in FIG. 10, the gate 44 is closed and the blow plate 70 is in sealed engagement with the blow head. A control mechanism programs the introduction of air into the blow head as follows: air is introduced into the upper tiers through the circular manifold 56 and through the sleeve 50 for about 1 second duration. Immediately thereafter pulses of air are simultaneously introduced through the respective nozzles 71 in the laminar agitator, each pulse being of about 1/50 second duration. This cycle of air from the upper tiers and from the laminar agitator is repeated as many times as is necessary depending upon a number of factors which include the quality of the sand, the time of binder, the size and shape of the core box and the like. It is to be understood that air into the laminar agitator may be introduced through all nozzles 71 simultaneously. It is also to be understood that the air to the laminar agitator may be introduced simultaneously with the air from the manifold 56 and sleeve 50. Any of many combinations of times, sequences and the like may be utilized in order to produce the desired result if introducing sand from the blow head into the core box as rapidly as possible and with a minimum of residual sand remaining after the core box has been filled.

With this system of filling the core box, a minimum amount of residual sand will remain and, hence, a minimal amount of binder will be used thereby keeping the cost of the operation to a minimum.

After the sand mix has been introduced into the core box, the machine table 23 is lowered slightly to cause a separation between blow plate 70 and the ring 60 at the lower end of the blow head. That separation is about one quarter inch. Simultaneously, air is introduced into cylinder 46 to effect the shifting of the gate 44 to open position.

Figure 12:
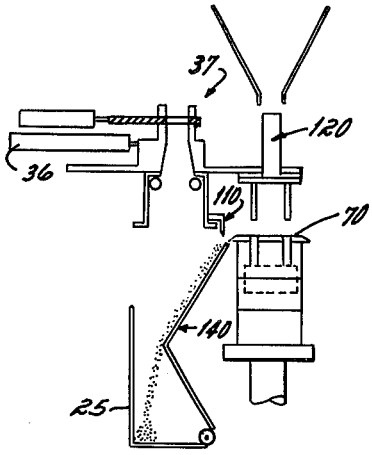

As shown in FIG. 12, air is introduced into the cylinder 36 to move the blow head 37 horizontally (toward the left in FIG. 12) and to bring the cleaning mechanism 120 into vertical alignment with the blow plate. In this operation, the brackets 101 slide away from the cope flanges 100 of the core box, thereby permitting the core box to be lowered with respect to the blow plate.

In moving horizontally to the left, the scraper 110 slides across the upper surface of the blow plate scraping residual sand mix off the blow plate and onto the side wall 140 of the waste receptacle 25 whereby the residual sand mix is discharged into the waste receptacle.

Figure 13:
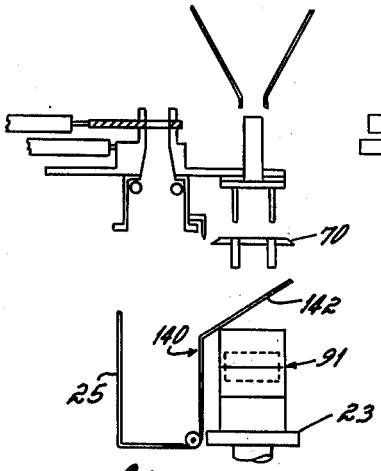

As shown in FIG. 13, the machine table 23 is then lowered to separate the core box from the blow plate 70. The blow plate 70 is retained by the rods 81, 82 in the position shown in FIG. 13. As the core box is lowered, the side wall 140 is swung to a more inclined attitude wherein the upper extension 142 of the side wall is disposed above the core box and below the blow plate so as to be between the two.

Figure 14:
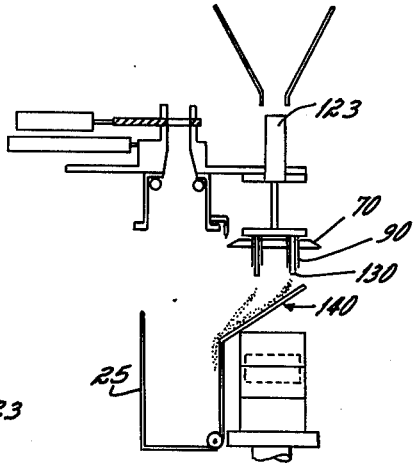

In the next operation, FIG. 14, the actuator 123 of the cleaning mechanism has air applied to it to drive the cleaning rods 130 through the respective blow tubes 90 on the blow plate 70 thereby driving any residual sand mix contained in the blow tubes downwardly onto the side wall 140. The sand mix particles then slide down into the waste receptacle 25.

Figure 15:
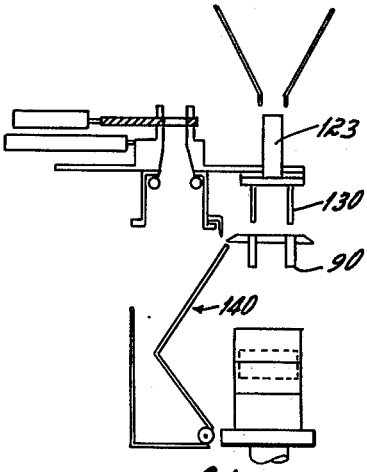

Referring to FIG. 15, the actuator 123 of the cleaning mechanism has its stroke reversed to withdraw the cleaning rods 130 from the blow tubes 90. Simultaneously, the side wall 140 is swung to its vertical attitude.

Figure 11:
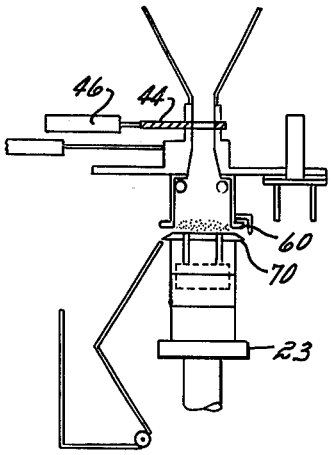
Figure 16:
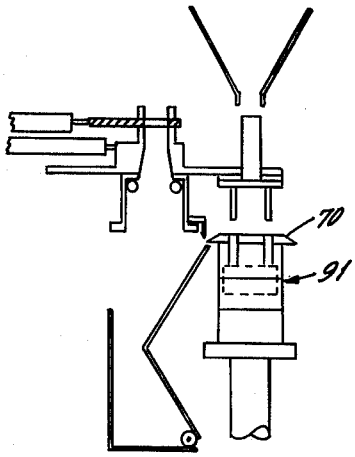

Referring to FIG. 16, the core box 91 is raised to a position of engagement with the blow plate 70, the blow plate still being in its lowered position of FIG. 11.

Figure 17:
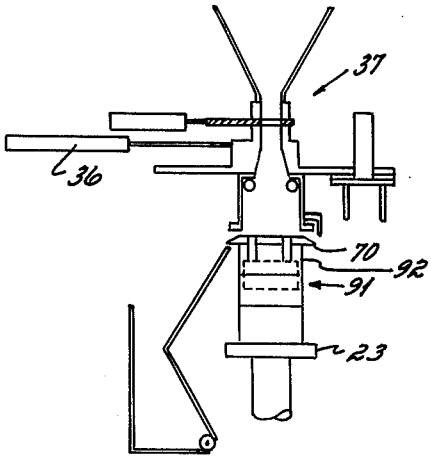

As shown in FIG. 17, the stroke of the cylinder 36 is reversed to return the blow head 37 to a position overlying the blow plate 70, thus bringing the legs 102 of the brackets 101 to a position underlying the flanges 100 of the cope 92.

Throughout all of the operations illustrated in FIGS. 10–17, the binder in the sand mix is constantly curing. The length of time for the cure is dependent upon the amount of catalyst in the binder. Approximately a 30 second cure is contemplated. At the conclusion of the operation illustrated in FIG. 17, the binder has set up so that a hardened core is now formed.

Figure 18:
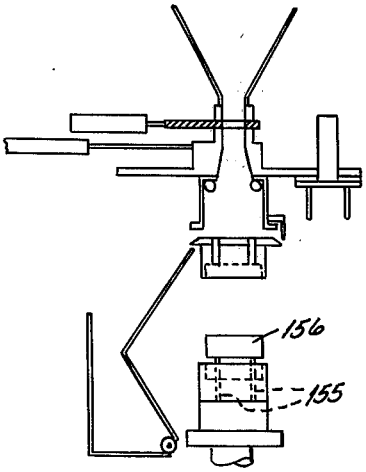

With the blow head in its original operative position and the cope blocked from downward movement by brackets 101, the machine table 23 is lowered carrying the drag 93 and core with it as shown in FIG. 18. Ejector pins 155, which are conventional, project upwardly through the drag to raise the thus formed core 156 out of the drag in a convenient position for manual removal.

Figure 19:
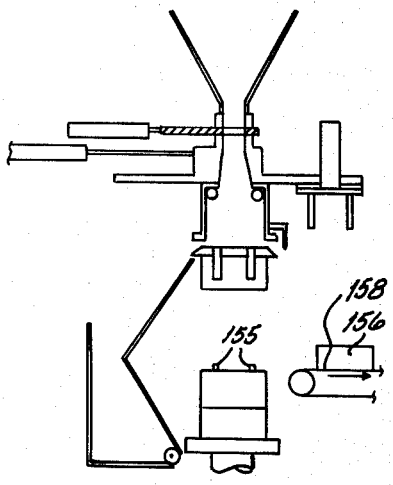

As shown in FIG. 19, the core 156 has been removed from the drag and placed on a conveyor 158 for further processing.

Figure 20:
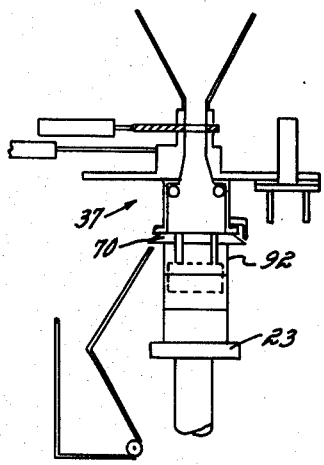

Referring to FIG. 20, the machine table 23 is raised to its uppermost extent to effect the mating of the drag with the cope to reform the core box and to bring the cope 92 into engagement with the blow plate 70 thereby forcing the blow plate into sealing engagement with the lower portion of the blow head 37. The apparatus is thus in condition to receive a new charge of sand.

Figure 21:
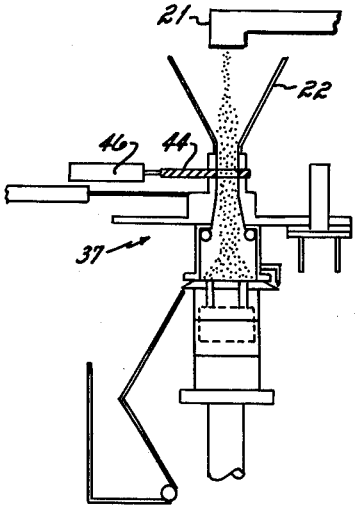
Figure 22:
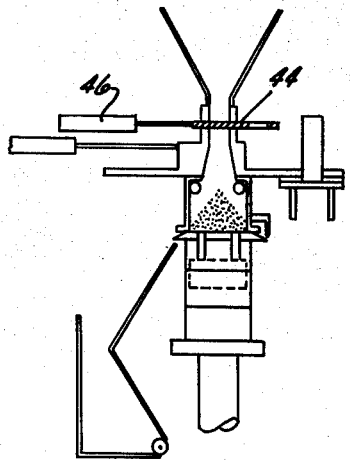

As shown in FIG. 21, a new batch of sand mix is discharged from the mixer 21 through the hopper 22 and the blow head 37. As the sand is moving downwardly, the respective vibrators 145 and 146 are operative to minimize the possibility of sand mix clinging to the vertical walls of the respective elements. After sand has been introduced into the blow head, the gate 44 is closed by reversing the air to the cylinder 46 and a new cycle of operations is ready to begin (see FIG. 22).

Figure 23:
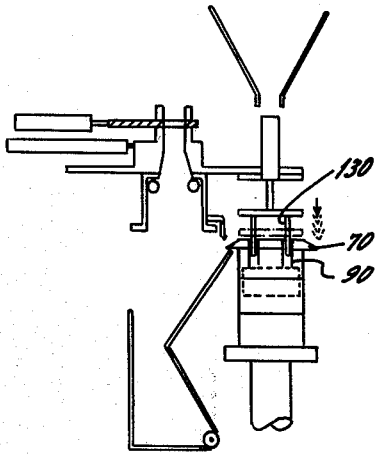

An optional operation is illustrated in FIG. 23, this operation to take place between the operations of FIGS. 12 and 13. The optional operation is to effect the compacting of the sand mix within the core box while driving the sand mix from the blow tubes. Thus, before the core box is lowered away from its operative position, the cleaning mechanism is energized downwardly to drive the cleaning rods 130 through the respective blow tubes 90 of the blow plate 70. The cleaning rods thus compact the sand in the core box while at the same time cleaning the blow tubes and eliminate a plurality of stacks of sand mix which otherwise would have set up in the blow tubes and which would otherwise have to be knocked off the core after removal from the core box.

I claim:

1. In a no bake sand molding apparatus having a frame, a machine table for supporting a core box, a hollow blow head overlying said machine table, and a mixer for introducing a charge of sand mix into said blow head, the improvement comprising, a blow plate located below said blow head, means mounting said blow plate on said frame for limited vertical movement with respect to said frame, said blow plate being movable upwardly into sealing engagement with said blow head prior to introducing a charge of sand mix into said blow head, said blow plate being movable to a lower position spaced slightly below said blow head to permit said blow plate to be cleaned immediately after said charge of sand mix has passed through said blow head, and means for cleaning said blow plate when it is in its lower position.

2. Apparatus as in claim 1 further comprising a sealing cord on the lower surface of said blow head to effect a seal between said blow head and blow plate when said blow plate is moved upwardly.

3. Apparatus as in claim 1 further comprising, a core box having a cope and drag mounted on said machine table, means for raising and lowering said machine table, said core box, when raised, engaging said blow plate to move said blow plate into engagement with said blow head.

4. Apparatus as in claim 1 further comprising a vibrator on said blow head to reduce the tendency of sand mix to adhere to vertical walls of said blow head.

5. Apparatus as in claim 1 in which said blow plate has a plurality of blow tubes depending therefrom, said tubes having an inside diameter d, said blow tubes being spaced from each other on centers which are approximately 2d.

6. In a no bake sand molding apparatus having a frame, a machine table for supporting a core box, a hollow blow head overlying said machine table, and a mixer for introducing a charge of sand mix into said blow head, the improvement comprising, a blow plate located below said blow head, means mounting said blow plate on said frame for limited vertical movement with respect to said frame, said blow plate being movable upwardly into sealing engagement with said blow head upon raising said machine table, said blow plate being movable to a lower position spaced slightly below said blow head to permit said blow plate to be cleaned, means mounting said blow head for horizontal movement with respect to said frame and said blow plate, a scraper mounted on said blow head and located to scrape across said blow plate when said blow head is moved horizontally with respect to said blow plate.

7. In a no bake sand molding apparatus having a frame, a machine table for supporting a core box, a hollow blow head overlying said machine table, and a mixer for introducing a charge of sand mix into said blow head, the improvement comprising, a blow plate located below said blow head,
means mounting said blow plate on said frame for limited vertical movement with respect to said frame,
said blow plate being movable upwardly into sealing engagement with said blow head upon raising said machine table,
said blow plate being movable to a lower position spaced slightly below said blow head to permit said blow plate to be cleaned,
means mounting said blow head for horizontal movement with respect to said frame and said blow plate,
a blow plate cleaning mechanism mounted adjacent said blow head for movement with said blow head,
said cleaning mechanism overlying said blow plate when said blow head is moved horizontally to one side of said blow plate.

8. In a no bake sand molding apparatus having a frame, a machine table for supporting a core box, a hollow blow head overlying said machine table, and a mixer for introducing a charge of sand mix into said blow head, the improvement comprising,
a blow plate located below said blow head,
means mounting said blow plate on said frame for limited vertical movement with respect to said frame,
said blow plate being movable upwardly into sealing engagement with said blow head upon raising said machine table,
said blow plate being movable to a lower position spaced slightly below said blow head to permit said blow plate to be cleaned,
means mounting said blow head for horizontal movement with respect to said frame and said blow plate,
a blow plate cleaning mechanism mounted adjacent said blow head for movement with said blow head,
said cleaning mechanism overlying said blow plate when said blow head is moved horizontally to one side of said blow plate,
said blow plate having a plurality of blow tubes depending therefrom,
said cleaning mechanism including a plurality of cleaning rods depending therefrom and alignable with said blow tubes,
an actuator for lowering said cleaning rods and forcing them through said blow tubes to clean residual sand from said tubes.

9. Apparatus as in claim 8 wherein each of said cleaning rods comprises,
an elastomeric tube,
a steel tip fixedly mounted on the lower end of said tube.

10. Apparatus as in claim 8 wherein said cleaning rods are mounted on a plate,
said plate being demountable from said actuator thereby permitting a quick change from one blow plate pattern to another.

11. In a no bake sand molding apparatus having a frame, a machine table for supporting a core box, a hollow blow head overlying said machine table, and a mixer for introducing a charge of sand mix into said blow head, the improvement comprising,
a blow plate located below said blow head,
means mounting said blow plate on said frame for limited vertical movement with respect to said frame,
said blow plate being movable upwardly into sealing engagement with said blow head upon raising said machine table,
said blow plate being movable to a lower position spaced slightly below said blow head to permit said blow plate to be cleaned,
a waste receptacle located alongside said machine table,
said receptacle including a movable side wall,
said side wall having a first, generally vertical, position wherein its upper edge is located adjacent said blow plate and an inclined position disposed between said blow plate and said core box to guide residual sand into said waste receptacle.

12. In a no bake sand molding apparatus having a frame, a machine table for supporting a core box, a hollow blow head overlying said machine table, and a mixer for introducing a charge of sand mix into said blow head, the improvement comprising,
a blow plate located below said blow head,
means mounting said blow plate on said frame for limited vertical movement with respect to said frame,
said blow plate being movable upwardly into sealing engagement with said blow head upon raising said machine table,
said blow plate being movble to a lower position spaced slightly below said blow head to permit said blow plate to be cleaned,
a scraper blade mounted on the lower end of said blow head adjacent said blow plate,
a blow tube cleaning mechanism mounted adjacent said blow head for movement with said blow head to and from positions of vertical alignment with said blow plate,
and means for moving said blow head in a horizontal direction to scrape said blow plate and to position said cleaning mechanism with respect to said blow plate for a cleaning operation.

13. In a no bake sand molding apparatus having a frame, a machine table for supporting a core box, a hollow blow head overlying said machine table, and a mixer for introducing a charge of sand mix into said blow head, the improvement comprising,
a blow plate located below said blow head,
means mounting said blow plate on said frame for limited vertical movement with respect to said frame,
said blow plate being movable upwardly into sealing engagement with said blow head upon raising said machine table,
said blow plate being movable to a lower position spaced slightly below said blow head to permit said blow plate to be cleaned,
means for introducing air under pressure to the upper portion of said blow head,
a laminar agitator for introducing a laminar flow of air across said blow plate into the lower end of said blow head.

14. Apparatus as in claim 13 in which said laminar agitator comprises,
a ring at the lower end of said blow head,
a plurality of nozzles mounted in said ring and having discharge ends directed generally horizontally across said blow plate.

15. Apparatus as in claim 14 further comprising means supplying sequential blasts of air to respective nozzles.

16. In a no bake sand molding apparatus having a frame, a machine table for supporting a core box, a hollow blow head overlying said machine table, and a mixer for introducing a charge of sand mix into said blow head, the improvement comprising, a blow plate located below said blow head, means mounting said blow plate on said frame for limited vertical movement with respect to said frame, said blow plate being movable upwardly into sealing engagement with said blow head upon raising said machine table, said blow plate being movable to a lower position spaced slightly below said blow head to permit said blow plate to be cleaned, vertical rods depending from said frame and connected to said blow plate to support said blow plate, means for disconnecting at least lower portions of said rods from upper portions thereof, said lower portions being pivoted at their lower ends to swing between an upper position and lower position, and means for connecting said lower portions to said machine table to permit said machine table to pull said blow plate downwardly to remove a cake of sand mix from said blow head.

17. In a no bake sand molding apparatus having a frame, a machine table for supporting a core box, a hollow blow head overlying said machine table, and a mixer for introducing a charge of sand mix into said blow head, the improvement comprising, a blow plate located below said blow head, means mounting said blow plate on said frame for limited vertical movement with respect to said frame, said blow plate being movable upwardly into sealing engagement with said blow head upon raising said machine table, said blow plate being movable to a lower position spaced slightly below said blow head to permit said blow plate to be cleaned, a core box having a cope and drag mounted on said machine table, means for raising and lowering said machine table, said core box, when raised, engaging said blow plate to move said blow plate into engagement with said blow head, a normally fixed support, spring means interposed between said blow plate and said support to urge said blow plate downwardly, said blow plate being raisable into engagement with said blow head against the action of said spring means upon moving said core box upwardly into engagement with said blow plate.

18. In a no bake sand molding apparatus having a frame, a machine table for supporting a core box, a hollow blow head overlying said machine table, and a mixer for introducing a charge of sand mix into said blow head, the improvement comprising, a blow plate located below said blow head, means mounting said blow plate on said frame for limited vertical movement with respect to said frame, said blow plate being movable upwardly into sealing engagement with said blow head upon raising said machine table, said blow plate being movable to a lower position spaced slightly below said blow head to permit said blow plate to be cleaned, a core box having a cope and drag mounted on said machine table, means for raising and lowering said machine table, said core box, when raised, engaging said blow plate to move said blow plate into engagement with said blow head, brackets depending from said blow head, said brackets being engageable with said cope to block downward movement of said cope when said machine table is lowered thereby separating said cope from said drag when said machine table is lowered.

* * * * *

UNITED STATES PATENT AND TRADEMARK OFFICE

CERTIFICATE OF CORRECTION

PATENT NO. : 4,140,171

DATED : February 20, 1979

INVENTOR(S) : Anatol Michelson

It is certified that error appears in the above-identified patent and that said Letters Patent are hereby corrected as shown below:

Column 1, line 62, "processin" should be -- process in --

Column 1, line 64, after "sand," insert the following:

-- scraped away to waste. A substantial amount of excess sand --

Column 12, line 27, "movble" should be -- movable --

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*